United States Patent [19]

Baatz et al.

[11] Patent Number: 4,866,286

[45] Date of Patent: Sep. 12, 1989

[54] APPARATUS AND METHOD FOR TRANSFERRING A RADIOACTIVE OBJECT FROM ONE CONTAINER TO ANOTHER

[75] Inventors: Henning Baatz, Essen; Dieter Methling, Hattingen, both of Fed. Rep. of Germany

[73] Assignee: GNS Gesellschaft Fur Nuklear-Service MBH, Essen, Fed. Rep. of Germany

[21] Appl. No.: 197,456

[22] Filed: May 23, 1988

[30] Foreign Application Priority Data

May 22, 1987 [DE] Fed. Rep. of Germany ..... 3717189

[51] Int. Cl.[4] ..... B21C 19/32

[52] U.S. Cl. ..... 250/507.1; 250/506.1; 376/272

[58] Field of Search ..... 250/505.1, 506.1, 507.1; 141/98; 376/272, 264

[56] References Cited

U.S. PATENT DOCUMENTS 4,081,086 3/1978 Shallenberger et al. ..... 376/264
4,659,536 4/1987 Baudro ..... 376/272
4,755,347 8/1988 Tolmie ..... 376/272
4,800,062 1/1989 Craig et al. ..... 376/272

*Primary Examiner*—Janice A. Howell
*Assistant Examiner*—John A. Miller
*Attorney, Agent, or Firm*—Herbert Dubno

[57] ABSTRACT

The apparatus for transferring at least one radioactive object from a first into a second container comprises a lifting tool with which the radioactive object is lifted from the first container and is lowered into the second container, a container-receiving member on which the first and second containers stand spaced from each other, a movable transfer slide provided with at least two container-cover cavities for receiving and securing first and second covers sealing respective containers and a transfer cover and the other container cover and a transfer receptacle in which the lifting tool is positionable which is combined with the movable transfer cover, is positionable over a hole provided in the movable transfer slide and is accessible from below. A method of operating this apparatus for transfer of a radioactive object is provided which does not require a special hot cell or room.

5 Claims, 2 Drawing Sheets

APPARATUS AND METHOD FOR TRANSFERRING A RADIOACTIVE OBJECT FROM ONE CONTAINER TO ANOTHER

FIELD OF THE INVENTION

The present invention relates to an apparatus and method for transferring or moving a radioactive object from one container to another container.

BACKGROUND OF THE INVENTION

The transfer of a radioactive object from one container to another container is generally carried out in a so-called "hot cell". One container is provided with a first container cover and the second container is provided with another or second container cover. Both container covers are removed during transfer of the radioactive object.

The radioactive object is lifted by a lifting tool from the first container and is lowered into the second container.

The first container can be a transporting and shielding container which is used for transport purposes, while the second other container can be used for storage.

The term "containers of a radioactive object" means containers in which the radioactive object is located and in which the object fits in appropriate cavities of the one and the other container. The radioactive objects can be cast blocks made from glass, plastic or metal in which radioactive or contaminated substances are poured or can be bodies made from the radioactive material. The radioactive object is prepared so that a lifting tool can be connected to it and the radioactive object can be manipulated with the lifting tool.

In the standard technique, the one container and the other container are placed beside each other. The container covers are removed. The radioactive object is lifted from the one container by the lifting tool, which is part of a crane, for example, and is lowered into the other container. This is not easy if the radioactive object swings on the lifting device. A major disadvantage is that these steps must be performed in a special hot cell or room.

OBJECT OF THE INVENTION

It is an object of the invention to provide an improved apparatus and method for transferring a radioactive object from one container to another which does not have the above mentioned disadvantage and/or difficulty.

It is also an object of the invention to provide an improved apparatus and method for transferring a radioactive object from one container to another which does not require an expensive hot cell.

SUMMARY OF THE INVENTION

These objects and others which will become more readily apparent hereinafter are attained in accordance with the invention in an apparatus and method for transferring a radioactive object from one container to another, each container being provided with its own cover. The container covers are removed during transfer of the radioactive object. Then the radioactive object is lifted with the help of a lifting tool from the one container and is lowered into the other container.

According to the invention the apparatus further comprises:

a container-receiving member on which the one container and the other container are positionable spaced from each other, a movable transfer slide with at least two container-cover cavities for the one container cover and the other container cover, and a transfer receptacle which is combined with the movable transfer cover, is positionable over a hole provided in the movable transfer cover and is accessible from below.

Furthermore, the method of operating this apparatus is such that the movable transfer cover first is movable with the container-cover cavities over the container-receiving member with the one container and the other container standing and the container covers are guided into and fixed in the container cover cavities, after that the movable transfer slide with the transfer receptacle is moved over the radioactive object to be raised in the one container which is now container-cover free into a first position and is movable into another or second position over the other container which is also container-cover free, and the radioactive object is lifted from the one container with the help of the lifting device guided through the transfer receptacle in the one position and is lowered in the other position into the other container, whereupon the movable transfer slide with the container-cover cavities is moved again over the one container and the other container and the container covers are replaced on the containers.

The movable transfer slide is equipped with components which are necessary to lift off the appropriate container covers from the one container and/or from the other container and secure them in the container cover cavities. After the end of the transfer of the radioactive object they are replaced on the one container and/or to the other container. That is accomplished with the aid of modern control and power engineering without difficulty and is accomplished easily because the described units are precisely correlated with each other with small tolerances in the apparatus according to the invention and consequently the corresponding motion and the securing and release steps are performed without difficulty.

Within the framework of the invention, the transfer receptacle can be equipped so that it simultaneously takes several radioactive objects and holds them when the one container and the other container are suitably equipped. It is also possible to provide the motion of the movable transfer slide so that with a transfer receptacle which can receive only one radioactive object, first and second containers can be used which each have several storage locations for radioactive objects. Only appropriate control engineering steps are then required in regard to the motion of the transfer slide and understandably the lifting tool.

In one embodiment of the invention the movable transfer slide is slidable linearly or in a straight line from the one to the other position, while in another embodiment the movable transfer slide can be a disk or a plate which is rotatable between the positions. In the case of a linear motion between positions, the movable transfer slide can be moved by a piston cylinder device or a chain drive. The movable transfer slide advantageously can be made from spherulitic cast iron.

The advantage attained by the invention is that the apparatus according to the invention does not require a hot cell or room. It operates reliably with simple drive and control means.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
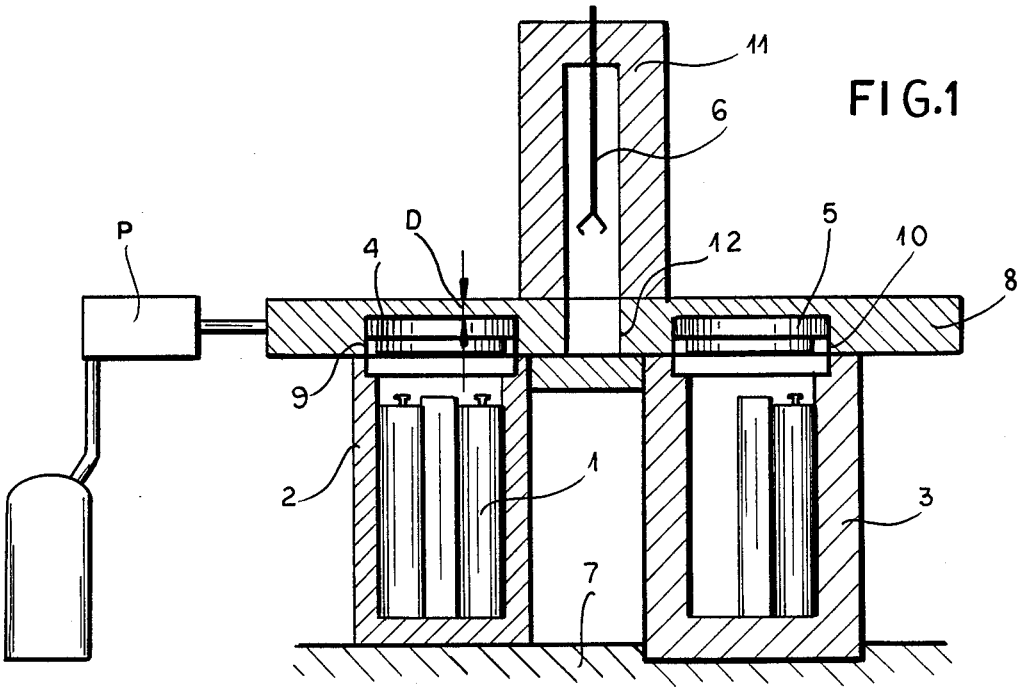
FIG. 1 is a cross-sectional view through an embodiment of an apparatus for transferring a radioactive object from one container to another according to the invention.

The apparatus shown in the drawing acts to transfer a radioactive object 1 from one first container 2 to another second container 3. The one container 2 is provided with one container cover 4, the other container 3 with another container cover 5.

These container covers 4, 5 are removed for the transfer of the radioactive object 1.

The radioactive object 1 is lifted from the one container 2 by a lifting tool 6 and is lowered by it into the other container 3. The apparatus comprises basically a container-receiving member 7 on which the one container 2 and the other container 3 are positionable spaced from each other, a movable transfer slide 8 with container-cover cavities 9, 10 for the one container cover 4 and for the other container cover 6 and a transfer receptacle 11 which is mounted on the movable transfer slide 8, is positionable over a hole 12 in the movable transfer slide 8 and is accessible from below through this hole 12.

In regard to operation, the apparatus is designed so that the movable transfer slide 8 with the container-cover cavities 9, 10 is moved over the container-receiving member 7 with the one container 2 and the other container 3 standing so that the container covers 4, 5 are recited in the container-cover cavities 9, 10 and are fixed in them.

That is the initial configuration which has been illustrated in FIG. 1.

The container covers 4, 5 are received so that the movable transfer slide 8 with the transfer receptacle 11 can be moved over the radioactive object 1 to be raised in the container cover free from first container 2. See FIG. 2.

Figure 3:
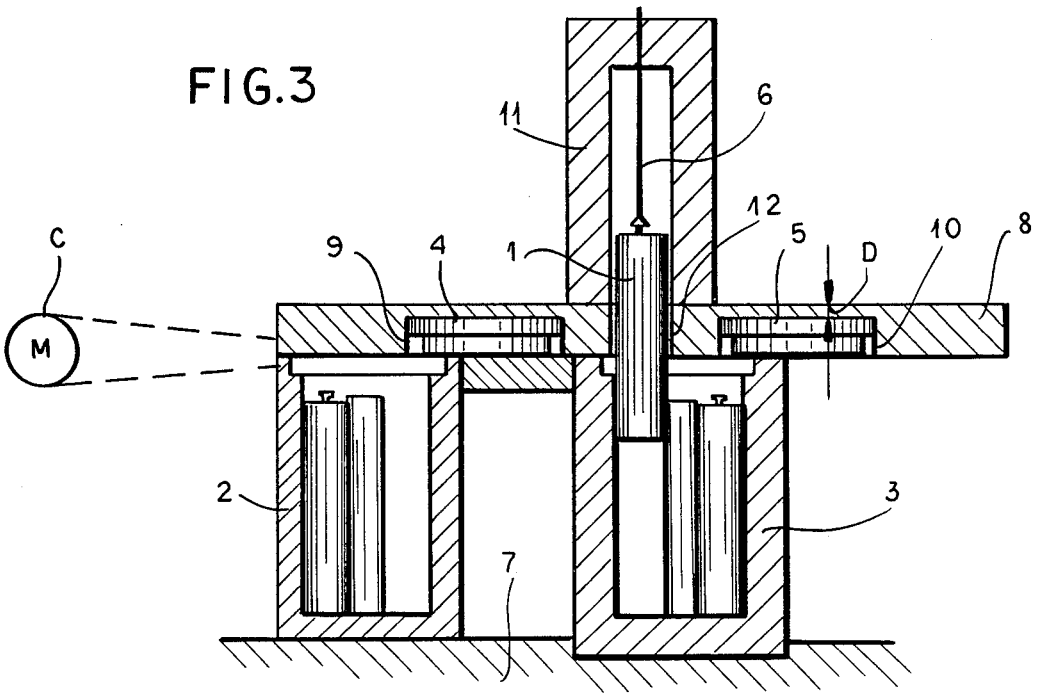
FIG. 3 is a cross-sectional view through the apparatus shown in FIG. 1 in a configuration in which the radioactive object is being lowered into the second or other container.

Then the transfer slide 8 can be moved over the container-cover free from the second other container 3 i.e. into the second position as has been illustrated in FIG. 3.

Figure 2:
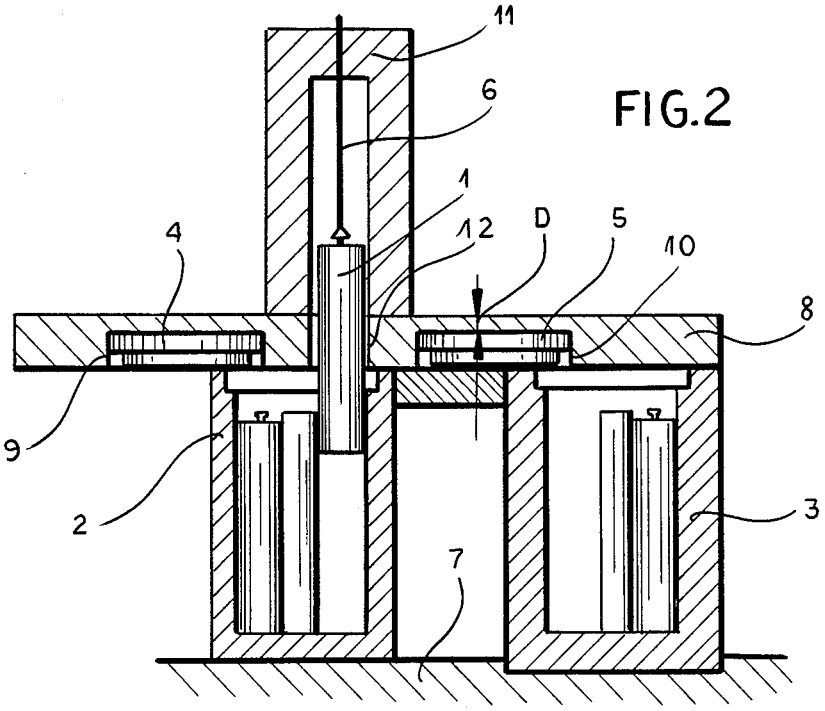
FIG. 2 is a cross-sectional view through the apparatus shown in FIG. 1 in a configuration in which the radioactive object is being raised from the first container.

The radioactive object 1 is raised by a lifting tool 6 guided through the transfer receptacle 11 in the one position shown in FIG. 2 and is lowered in the other or second position shown in FIG. 3 into the other or second container 3.

The transfer slide 8 with the container-cover cavities 9, 10 again travels over the one first container 2 and the other second container 3 and the container covers 4, 5 are again replaced. The movable transfer slide 8 is constructed as a radiation shield and is of a thickness to prevent a radioactive leakage. The design is such that in the vicinity of the container-cover cavities 9, 10 the container covers 4, 5 received therein and the residual thickness D of the movable transfer slide 8 function as a shield. The movable transfer slide 8 comprises advantageously spherulitic cast iron.

In the embodiment according to FIGS. 1 to 3, the movable transfer slide 8 completes a linear motion which is caused by a chain drive C shown in FIG. 3 or a piston-and-cylinder device P shown in FIG. 1.

Figure 4:
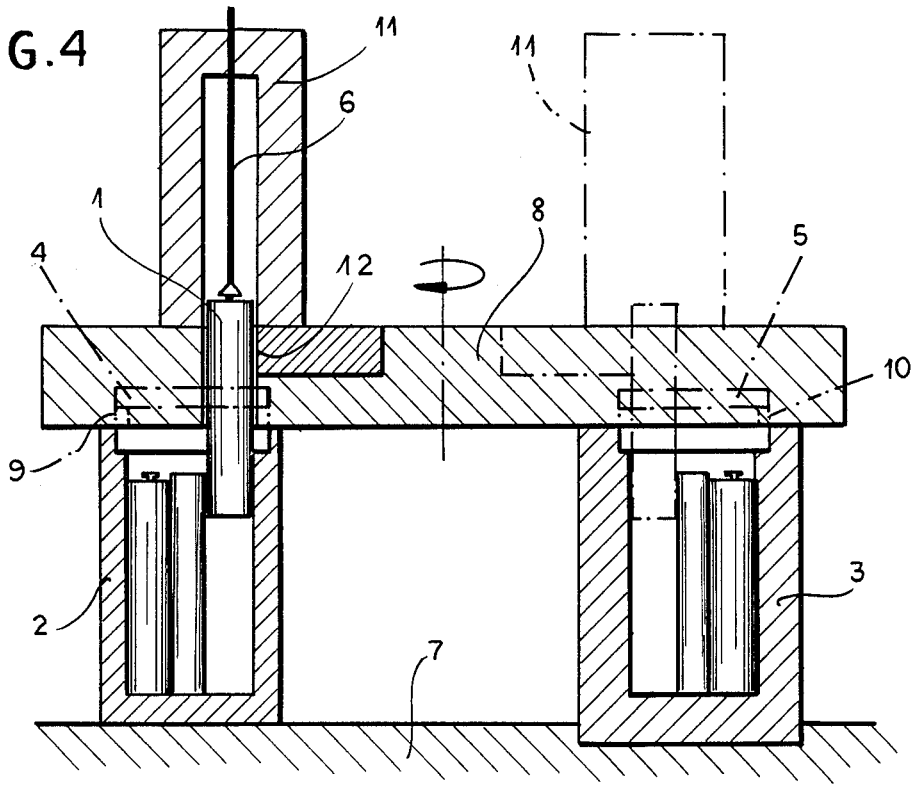
FIG. 4 is a cross-sectional view through another embodiment of an apparatus for transferring a radioactive object from one container to another in a configuration in which the radioactive object is being raised from the first container.

FIG. 4 differs from the earlier embodiment in that the movable transfer slide 8 comprises a rotating disk or plate.

Accordingly, the container-cover cavities 9, 10 are positioned on a circle adjacent the positions indicated in FIG. 4. In FIG. 4 the container-cover cavities 9, 10 with the container covers 4, 5 are indicated with dot-dashed lines. In FIG. 4, a radioactive object 1 is raised from the one container 2 and fed into the transfer receptacle 11. After that, a rotation about 180° occurs to attain the position indicated with dot-dash lines in FIG. 4 in which it is possible to guide the radioactive object 1 from the transfer receptacle 11 into the second other container 3.

Alternatively, referring to the embodiment according to FIGS. 1 to 3, several radioactive objects 1 can be lifted from the one container 2 and placed in the other container 3. Furthermore, the one container 2 and the other container 3 could be suitably rotated. The container-receiving member 7 could have appropriate devices for performing this rotation. However, referring to the embodiment according to FIGS. 1 to 3 it is also possible to equip the movable transfer slide 8 with appropriate added degrees of freedom and positions. In the embodiment of FIG. 4 it is for the same purpose the one container 2 and the other container 3 may be rotated about their axes.

What is claimed is:

1. An apparatus for transferring at least one radioactive object, comprising:

a first container within which said radioactive object is held;

a second container to which said radioactive object is to be transferred;

a first cover to seal a mouth of said first container;

a second cover to seal a mouth of said second container;

means for lifting said radioactive object from inside said first container and lowering said radioactive object into said second container;

a container-receiving member on which said first and second containers are positionable spaced from one another;

a movable transfer slide provided with at least two container-cover cavities for receiving and securing said first and second covers, said movable transfer slide being constructed as a radioactive shield and in a vicinity of said container-cover cavities said covers being received therein and a residual thickness of said movable transfer slide functioning as said shield; and a radioactively shielded transfer receptacle for housing said means for lifting, said transfer receptacle being combined with said movable transfer slide, said transfer receptacle being positionable over a hole provided in said movable transfer slide and being accessible from below.

2. The improvement defined in claim 1 wherein said movable transfer slide comprises means to be slidable linearly or in a straight line by a chain drive or a piston-and-cylinder device.

3. The improvement defined in claim 1 wherein said movable transfer slide is constructed as a rotating plate.

4. The improvement defined in claim 1 wherein said movable transfer slide is made of spherulitic cast iron.

5. A method of transferring a radioactive object from a first container with a first cover to a second container with a second cover without a special hot room or cell by means of an apparatus comprising a lifting tool with which said radioactive object is raised or lowered, a radioactively shielded movable transfer slide with at least two container-cover cavities for said covers at least temporarily covering both of said containers and a radioactively shielded transfer receptacle movable between at least two positions relative to said containers in which said lifting tool operates to bring in and to feed said radioactive object from said containers sequentially comprising the steps of:

(a) moving said movable transfer slide with said container-cover cavities over said first container and said second container;

(b) guiding and securing said container covers in said container cover cavities;

(c) moving said movable transfer slide with said transfer receptacle over said radioactive object to be raised in said first container which now is container cover free into one of aid positions and then lifting said radioactive object from said first container with the help of said lifting tool guided through said transfer receptacle in said one position;

(d) moving said transfer slide with said transfer receptacle into another of said positions over said other container which is now also container cover free and lowering said radioactive object into said second container in said another position; and (e) moving said transfer side with said container-cover cavities again over said first and second containers and replacing said respective covers on said containers.

* * * * *